US006180904B1

(12) United States Patent
Bauer et al.

(10) Patent No.: US 6,180,904 B1
(45) Date of Patent: Jan. 30, 2001

(54) ACTIVATION KEYBOARD, PARTICULARLY FOR MOTOR-VEHICLE CLIMATE CONTROLS

(75) Inventors: Karl-Heinz Bauer, Bad Neustadt; Thilo Kirchner, Premich; Joachim Storath, Salz, all of (DE)

(73) Assignee: Preh-Werke GmbH & Co. KG, Bad Neustadt/Saale (DE)

( * ) Notice: Under 35 U.S.C. 154(b), the term of this patent shall be extended for 0 days.

(21) Appl. No.: 09/435,648

(22) Filed: Nov. 9, 1999

(30) Foreign Application Priority Data

Nov. 21, 1998 (DE) ..... 198 53 753

(51) Int. Cl.[7] ..... H01H 13/70; H01H 9/02

(52) U.S. Cl. ..... 200/523; 200/296; 200/341; 200/5 A

(58) Field of Search ..... 200/5 R, 5 A, 200/16 R, 17 R, 18, 520, 523, 293, 295, 296, 329, 341, 344, 345; 400/472, 490, 491, 491.2, 495, 495.1, 496

(56) References Cited

U.S. PATENT DOCUMENTS

| | | | | |
|---|---|---|---|---|
| 4,635,354 | | 1/1987 | Chrobak et al. | 29/622 |
| 4,816,961 | * | 3/1989 | Saulgeot et al. | 361/142 |
| 4,918,271 | | 4/1990 | Deeg | 200/344 |
| 5,120,923 | | 6/1992 | Kato et al. | 200/520 |
| 5,565,865 | * | 10/1996 | So | 341/20 |
| 5,570,114 | * | 10/1996 | Fowler | 345/173 |
| 5,588,760 | | 12/1996 | So | 400/495 |
| 5,821,490 | * | 10/1998 | Blossfeld | 200/524 |
| 5,887,704 | * | 3/1999 | Schorpp et al. | 200/296 |
| 5,941,373 | * | 8/1999 | Cheng | 200/344 |

FOREIGN PATENT DOCUMENTS

| | | | |
|---|---|---|---|
| 41 12 646 A1 | 2/1992 | (DE) | H01H/13/52 |
| 43 44 054 C2 | 6/1995 | (DE) | B60H/1/00 |
| 44 10 512 A1 | 10/1995 | (DE) | H01C/1/012 |
| 196 27 213 C1 | 11/1997 | (DE) | H01H/13/70 |
| 0 157 037 A2 | 10/1985 | (EP) | H01H/13/02 |
| 2 150 722 | 7/1985 | (GB) | H03M/11/00 |

* cited by examiner

*Primary Examiner*—Michael Friedhofer
(74) *Attorney, Agent, or Firm*—Birch, Stewart, Kolasch & Birch, LLP

(57) ABSTRACT

A keyboard has keys, or buttons, having guide projections which, when the keys are pushed from an operating side, are shoved along guide plates, with motion being restricted by a locator, the locator having two stops which restrict the motion of the keys between the two stops and with a switch being activated being ON and OFF by the key moving within these limits. This provides a very flat keyboard which is economical to manufacture.

11 Claims, 4 Drawing Sheets

FIG. 9
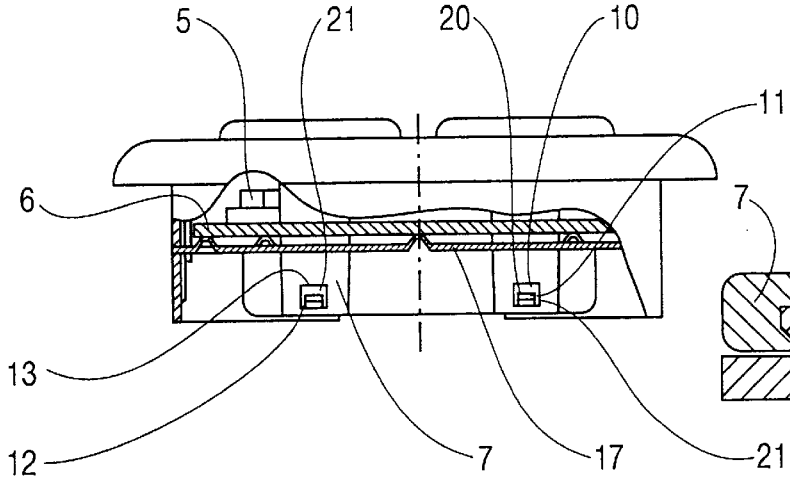
FIG. 13
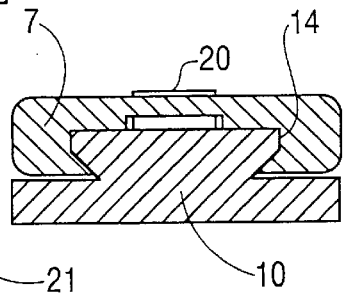
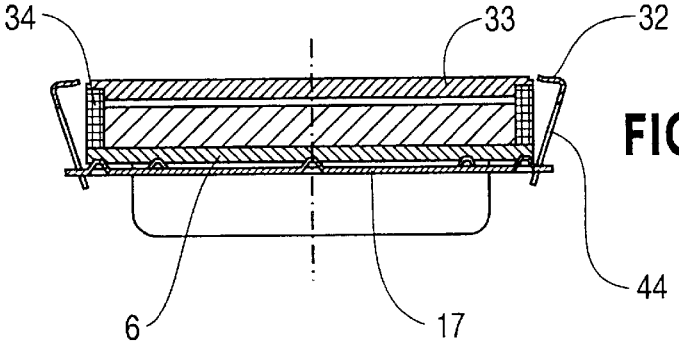
FIG. 10
FIG. 11
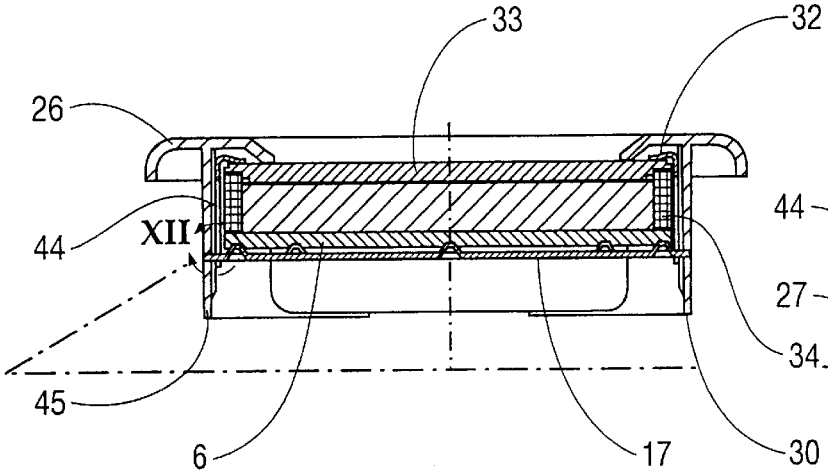
FIG. 12
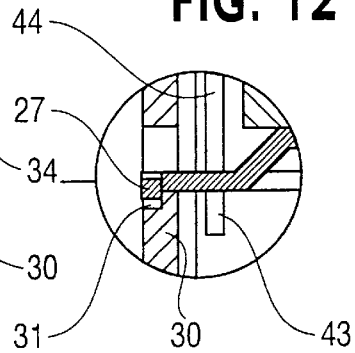

ACTIVATION KEYBOARD, PARTICULARLY FOR MOTOR-VEHICLE CLIMATE CONTROLS

BACKGROUND OF THE INVENTION

This invention concerns an activation keyboard, especially for a motor-vehicle climate control device for being installed from a front side of a dashboard instrument panel, which keyboard includes a housing in which a circuit board having electric and electronic components thereon is arranged, with a plurality of keys, or buttons, of the keyboard acting on switches of the circuit board.

Such a keyboard is disclosed in German patent document DE 43 44 054 C2, but this keyboard has a large depth, which is troublesome in some applications. Moreover, there is a need for a keyboard having a structure that can be assembled from its individual parts without further connecting elements such as screws, rivets or the like.

Thus, it is an object of this invention to provide a keyboard of the type described in the opening paragraph above having a small depth and allowing an uncomplicated mounting without the use of connecting elements.

SUMMARY OF THE INVENTION

According to principles of this invention, a keyboard of the general type described above has keys, or buttons, having guide projections which, when the keys are pushed from an operating side, are shoved along guide plates, or stemples with motion of each key being restricted by a locator, the locator having two stops which restrict the motion of the key between the two stops and with a switch activated by the key being switched ON and OFF within this motion. Advantageous embellishments are also possible.

BRIEF DESCRIPTION OF THE DRAWINGS

The invention is described and explained in more detail below using embodiments shown in the drawings. The described and illustrated features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

FIG. 12 is an enlarged view of a portion XII of FIG. 11 enclosed in a dashed line, and FIG. 13 is a cross-sectional view of a dovetail guide used in this invention.

DETAILED DESCRIPTION OF THE INVENTION

Figure 1:
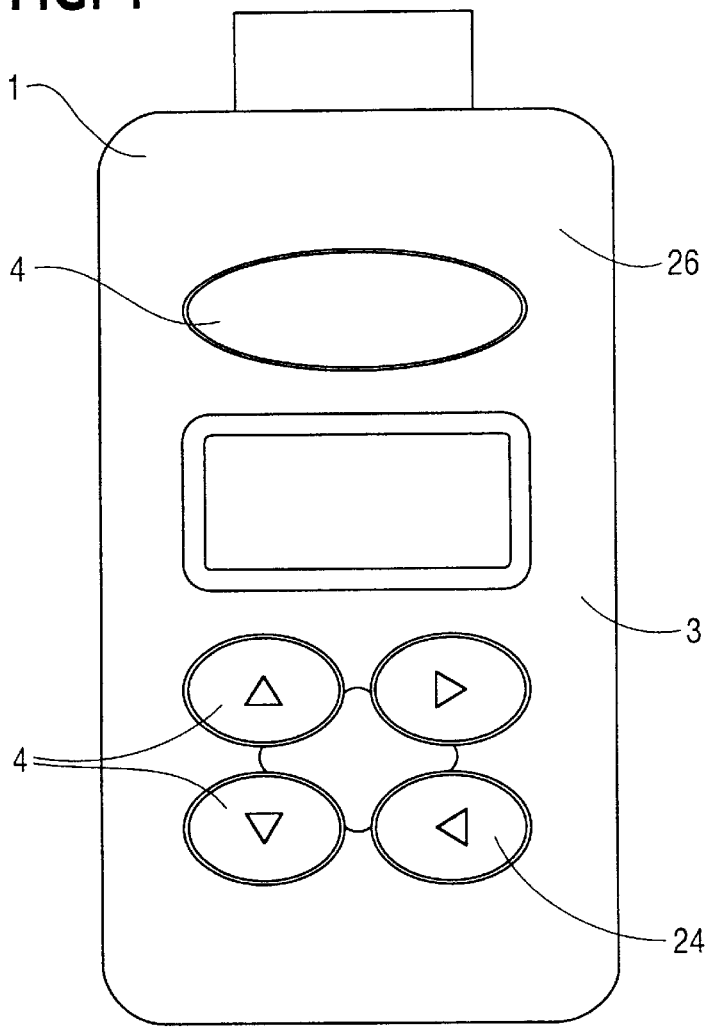
FIGS. 1 and 2 are respectively top plan and side-elevation views of a keyboard of this invention.
Figure 2:
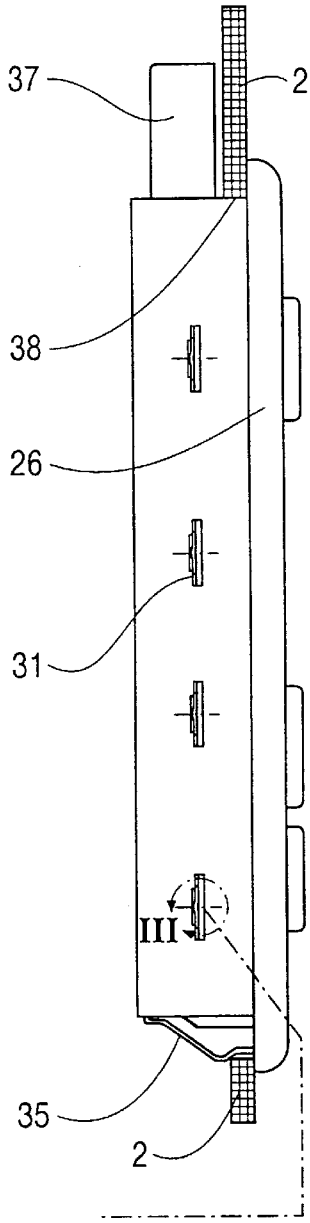

FIG. 1 shows a plan view and FIG. 2 a side view of a keyboard 1, especially for use to control a motor-vehicle air conditioner, which is front mounted in a dashboard instrument panel 2, the keyboard including a housing 3, in which electrical and electronic components are arranged, with a plurality of keys, or buttons, 4 of the keyboard acting on switches 5 (FIG. 9) arranged on a circuit board 6 (FIG. 9).

Figure 5:
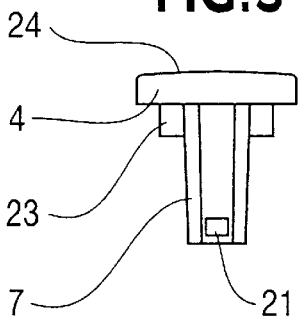
Figure 6:
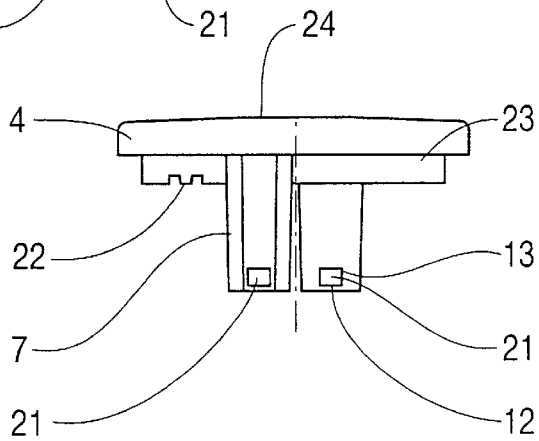

The keys 4, shown in FIGS. 5 and 6, are pushed, from an operating side thereof so that their guide projections 7 slide along guide plates 10 and the keys are held by snap-in locators 11 which limit displacement, or motion, between two stops 12, 13, with each switch 5, which is activated by a respective key 4, being switched ON and OFF within this displacement.

Figure 7:
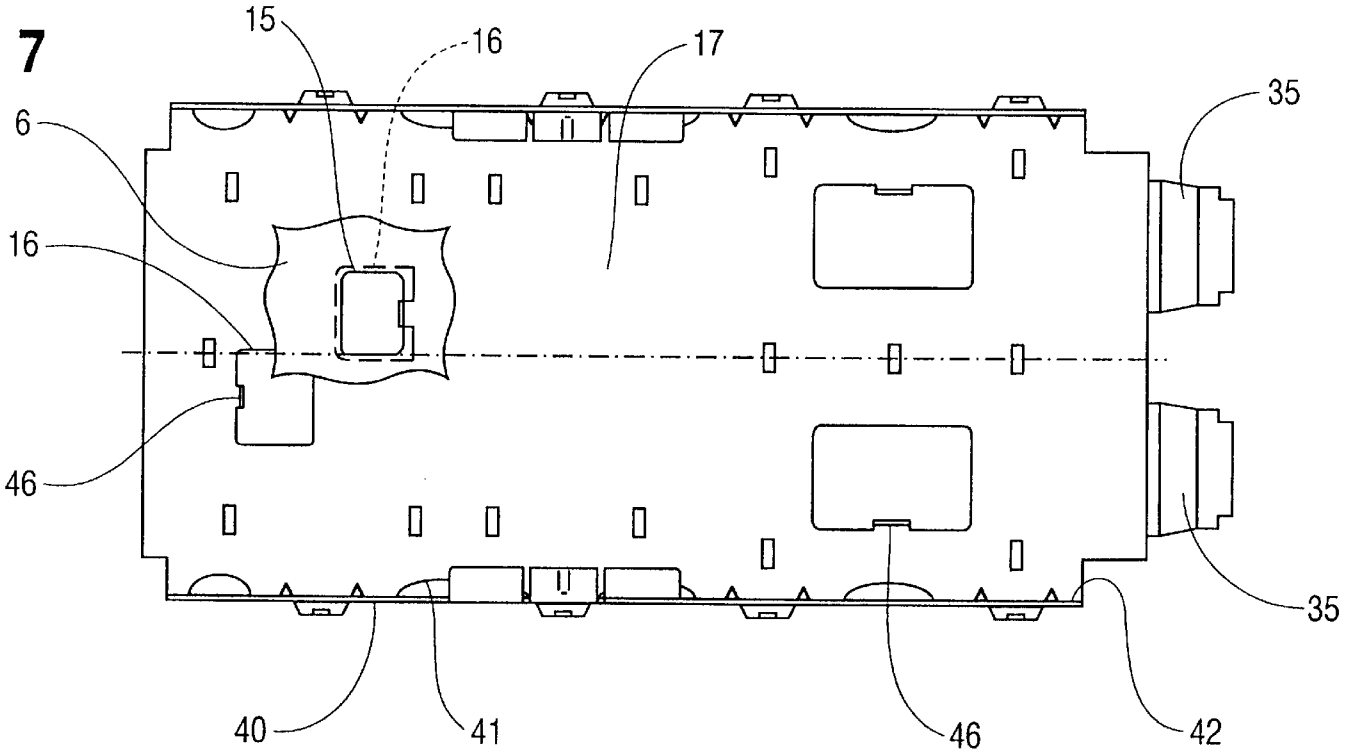

It is advantageous for the guide plate 10 and guide projection 7 to form an interlocking dovetail guide 14 (FIG. 13), which extends through the openings 15, 16 of the circuit board 6 and a carrier plate 17 (FIGS. 7, 9). This structure allows placement of the circuit board 6 quite close to the keys 4, with a so-called "drawer-effect", preventing a tilting, or cocking, of the keys 4.

The locator 11 is formed as a locking tab 20 on the guide plate 10 and a cutout 21 in the guide projection 7; which may be seen in FIG. 9, with the locking tab 20, because of elastic deformation of the wall of the guide projection 7, snapping into the cutout 21. Thus, connecting and securing elements are not needed.

Because key surfaces 22 of the keys 4 which contact the switches 5 are made in key frames 23, a flat structure also results, with the key frames 23 assuring no deformation of the keys 4 themselves (FIGS. 5, 6).

Figure 4:
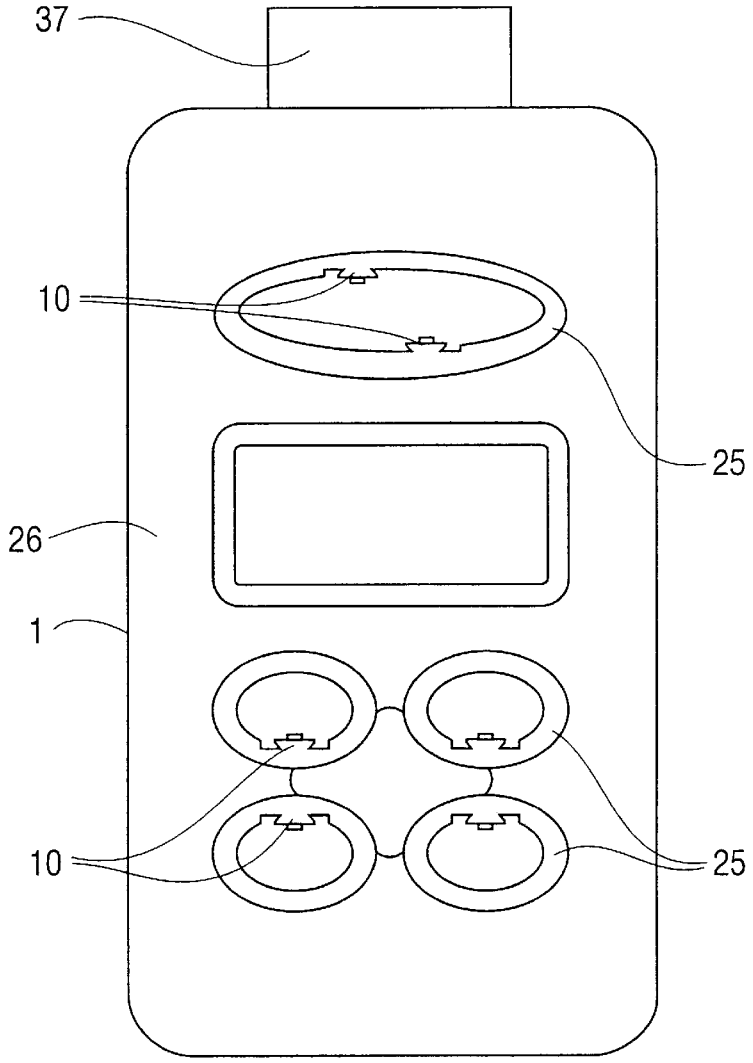
FIG. 4 is a top plan view of a front side (operating side) of a housing of the keyboard of FIG. 1, FIGS. 5 and 6 are side views of keys, or buttons, of the keyboard of FIG. 1, FIGS. 7 and 8 are respectively top plan and side views of a carrier plate of the keyboard of FIG. 1, with segmented portions of the circuit board being shown in FIG. 7 and segmented portions of the housing and circuit board being shown in FIG. 8, FIGS. 9 to 11 are cutaway views of portions of the keyboard of FIG. 1.

Front, visible, key-surface walls 24 extend beyond the key frames 23 (FIGS. 5, 6) and are guided in key-guide openings 25 of a housing front wall 26 (FIG. 4). A pleasing appearance is achieved in this way and light escape from illumination elements (not shown) in an interior of the keyboard 1 is prevented.

Figure 3:
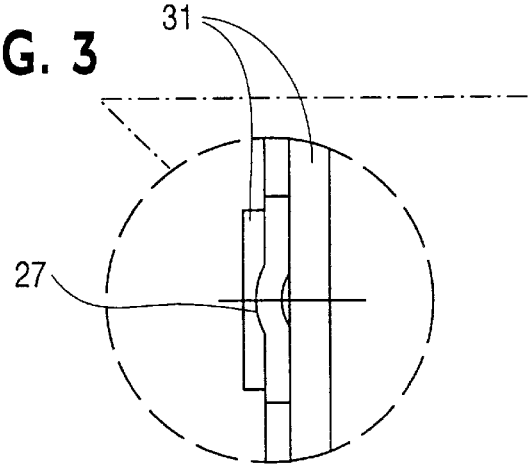
FIG. 3 is an enlarged view of a portion III circled by a dashed line in FIG. 2.

It is advantageous for the circuit board 6 to be borne by a carrier plate 17, having clip attachments 27 inserted in a housing wall 30 (FIG. 12) and held in clip-slots 31 of the housing wall 30 (FIG. 3). With this arrangement, an economical assembly of the keyboard 1 is achieve (FIG. 9).

To indicate desired, adjusted standard data, the keyboard has a conventional LCD display (FIG. 10), with bent gripper strips 32 of the carrier plate 17, securing an LCD-element 33 that is in electrical contact with leads of the circuit board 6 vie compressed conductive-rubber pieces 34. A durable, elastic retention of the LCD element 33 is assured by the compressed conductive rubber pieces 34.

Figure 8:
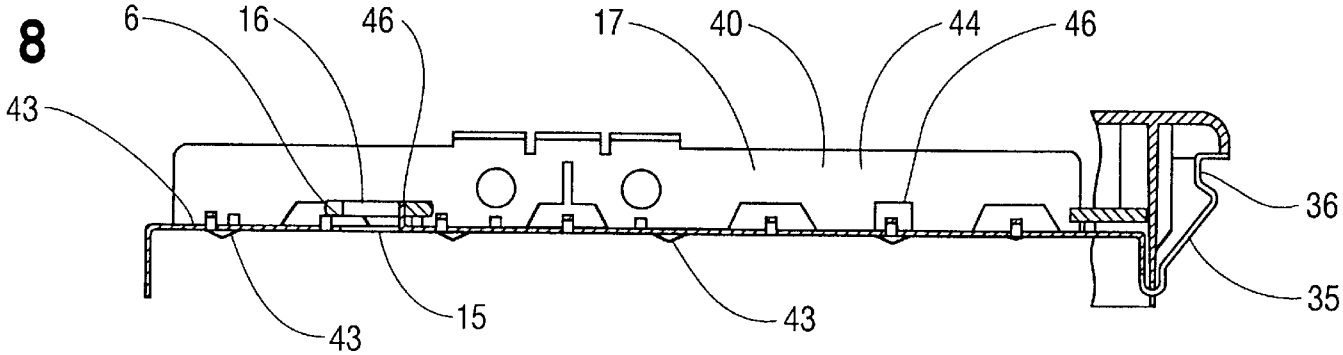

For an uncomplicated mounting of the keyboard 1 in an opening in the instrument panel 2, the carrier plate 17 is provided with a spring bracket 35 (FIGS. 7, 8) for reaching around the housing-frame to be sprung inwardly by the instrument-panel wall of the instrument panel 2 when the keyboard 1 is mounted therein, and for clamping about this instrument-panel wall with a complementary hook structure 36; an opposite other side of the housing wall 30 (FIG. 2) forming a receiving groove 38 for the instrument-panel wall with a receptacle part 37 and a housing front wall 26. In this way, only the receiving groove 38 portion of the keyboard 1 need be placed, in the opening of the instrument panel 2, that is, placed on the instrument panel wall, with the other side then being pressed into the opening, so that the spring bracket 35 flexes inwardly and clamps about the instrument panel wall with the hook structure 36. In this way, an uncomplicated fastening of the keyboard 1 is achieved.

As presented in FIGS. 8 to 11, which show cross-sections of portions of the keyboard 1, the bent gripper strips 32, on both sides of the carrier plate 17, are of bent angle brackets 40, with cutouts 41 at a bending area 42 (FIGS. 7, 8) being so arranged that legs 43, 44 are created above and below the bending zone 42, so that the legs 43, 44 align the angle bracket 40 parallel relative to housing wall 45.

In addition, the carrier plate 17, can have bent affixing surfaces 46 in the cutouts 16, through which the guide plates 10 extend on which the circuit board 6 can be supported for proper positioning.

FIG. 12 shows an enlarged section from FIG. 11, from which may be seen, how the clip elements 27 of the carrier plate 17 are snapped into the clip slots 31, and likewise, how the legs 43, 44 align the angle bracket 40 parallel relative to housing wall 45.

What is claimed is:

1. A keyboard for a control device for being installed from a front side of an instrument panel, said keyboard including a housing, in which a circuit board having electric and electronic components is arranged, there being a plurality of keys of the keyboard acting on switches supported on an operating side of the circuit board, wherein:

each key of said keys has an operating member positioned on the operating side of the circuit board and further including a guide projection which, when the operating member of the key is pushed toward the operating side of the circuit board, is shoved along a guide plate and held by a locator, the locator having two stops which restrict motion to displacement of the key between the two stops, one of the switches being activated ON and OFF by the key being moved through this displacement of the key;

wherein the guide plate and the key guide projection pass through an opening in said circuit board, and wherein said operating member includes a key surface for contacting at least the one of the switches being activated ON and OFF on the operating side of the circuit board for causing this actuation.

2. The keyboard of claim 1, wherein the guide plate and the key guide projection form a dovetail guide, which passes through the openings in the circuit board and a carrier plate located in the housing.

3. The keyboard of claim 2, wherein the locator is formed by a locking tab on one of the guide plate and the guide projection and by a cutout in the other of the guide plate and the guide projection, and wherein the locking tab snaps into the cutout because of elastic deformation.

4. The keyboard of claim 3, wherein each of said key surfaces for contacting at least one of the switches is formed in a key frame of its respective key operating member.

5. The keyboard of claim 4, wherein visible front side surfaces of the operating members of the keys extend laterally beyond the key frames and are movable into key guiding openings in a housing front wall.

6. The keyboard of claim 5, wherein the circuit board is borne by the carrier plate having clip attachments which are inserted into and retained in clip slots in a housing side wall.

7. The keyboard of claim 6, wherein the carrier plate has bent gripper strips for retaining an LCD element, which is in electrical contact with the circuit board by compressed, conductive rubber pieces.

8. The keyboard of claim 7, wherein the carrier plate has a spring bracket passing around the housing side wall on one side of the housing, said spring bracket springing inwardly upon the keyboard being moved through an opening in an instrument panel, and said spring bracket clamping about the instrument panel with a complementary hooked end, while, at an opposite other side of the housing, a receiving slot for the instrument panel wall is formed by a projecting receptacle part and a front flange of the housing front wall.

9. The keyboard of claim 7, wherein bent gripper strips on opposite sides of the carrier plate are formed as angle brackets, with cutouts at a bending line creating legs extending above and below the bending line, so that the legs align the angle brackets parallel relative to the housing wall.

10. The keyboard of claim 7, wherein the carrier plate has bent affixing surfaces passing through the cutouts through which the guide plates extend which the circuit board engages.

11. A keyboard for a control device for being installed from a front side of an instrument panel, said keyboard including a housing, in which a circuit board having electric and electronic components is arranged, there being a plurality of keys of the keyboard acting on switches supported on the circuit board, wherein:

each key of said keys has a guide projection which, when the key is pushed on an operating side of the key, is shoved along a guide plate and held by a locator, the locator having two stops which restrict motion to displacement of the key between the two stops, one of the switches being activated ON and OFF by the key being moved through this displacement of the key;

wherein the guide plate and the key guide projection form a dovetail guide which passes through an opening in said circuit board and a carrier plate located in the housing.

* * * * *